US010676311B2

(12) United States Patent
Kawahara et al.

(10) Patent No.: US 10,676,311 B2
(45) Date of Patent: Jun. 9, 2020

(54) METHOD OF MANUFACTURING AND MANUFACTURING DEVICE FOR PARTIAL SPLIT-FIBER FIBER BUNDLE AND PARTIAL SPLIT-FIBER FIBER BUNDLE

(71) Applicant: Toray Industries, Inc., Tokyo (JP)

(72) Inventors: Yoshihiro Kawahara, Otsu (JP); Tamotsu Suzuki, Otsu (JP); Katsuhiro Miyoshi, Nagoya (JP)

(73) Assignee: Toray Industries, Inc., Tokyo (JP)

( * ) Notice: Subject to any disclaimer, the term of this patent is extended or adjusted under 35 U.S.C. 154(b) by 279 days.

(21) Appl. No.: 15/539,459

(22) PCT Filed: Dec. 9, 2015

(86) PCT No.: PCT/JP2015/084562

§ 371 (c)(1),
(2) Date: Jun. 23, 2017

(87) PCT Pub. No.: WO2016/104154

PCT Pub. Date: Jun. 30, 2016

(65) Prior Publication Data

US 2017/0355550 A1 Dec. 14, 2017

(30) Foreign Application Priority Data

Dec. 26, 2014 (JP) ..... 2014-264432

(51) Int. Cl.
*B65H 51/005* (2006.01)
*D01D 11/02* (2006.01)
(Continued)

(52) U.S. Cl.
CPC ..... *B65H 51/005* (2013.01); *D01D 11/02* (2013.01); *D02J 1/18* (2013.01); *D01D 5/423* (2013.01)

(58) Field of Classification Search
CPC ..... D02J 1/18; D02J 1/02; D02J 1/06; D02J 1/08; D02J 1/16; D02J 11/00; D01D 11/02; D01D 5/423; B65H 51/005
(Continued)

(56) References Cited

U.S. PATENT DOCUMENTS 2,278,879 A * 4/1942 Hunter ..... D01H 5/36 19/0.56
3,034,180 A * 5/1962 Greiner ..... D04H 1/495 19/301
(Continued)

FOREIGN PATENT DOCUMENTS

EP 2 687 356 A1 1/2014
JP 7-227840 A 8/1995
(Continued)

*Primary Examiner* — Amy Vanatta
(74) *Attorney, Agent, or Firm* — DLA Piper LLP (US)

(57) ABSTRACT

A method of manufacturing and a device for manufacturing a partial split-fiber fiber bundle and a partial split-fiber fiber bundle obtained are characterized by piercing a fiber splitting means provided with a plurality of protruding parts into a fiber bundle formed from a plurality of single fibers while making the fiber bundle travel along the longitudinal direction thereof and creating a split-fiber processed part, forming entangled parts where single fibers are interlaced at contact parts with the protruding parts in at least one split-fiber processed part, thereafter pulling the fiber splitting means out of the fiber bundle, and after passing through an entanglement accumulation part including the entangled parts, once again piercing the fiber splitting means into the fiber bundle.

32 Claims, 9 Drawing Sheets

(51) Int. Cl.
*D02J 1/18* (2006.01)
*D01D 5/42* (2006.01)

(58) Field of Classification Search
USPC ..... 28/282, 252, 253, 247
See application file for complete search history.

(56) References Cited

U.S. PATENT DOCUMENTS 3,126,095 A * 3/1964 Caines ..... A24D 3/0204 428/369
3,208,125 A * 9/1965 Hall ..... D02G 1/00 28/219
3,255,506 A * 6/1966 Fritz ..... B01D 39/18 156/433
3,448,500 A * 6/1969 Benson ..... D02G 1/16 28/271
3,460,416 A 8/1969 Gilbert
6,032,342 A * 3/2000 Kawabe ..... D01G 9/08 28/283
6,094,791 A 8/2000 Akase et al.
6,311,375 B1 * 11/2001 Patrick ..... D02G 3/22 28/107
6,684,468 B1 * 2/2004 Lujan ..... D02J 1/18 28/103
2006/0137156 A1 * 6/2006 Kawabe ..... B29C 70/20 28/271
2012/0213997 A1 8/2012 Wang et al.
2013/0174969 A1 7/2013 Karb et al.
2013/0317161 A1 11/2013 Konagai et al.
2015/0203642 A1 7/2015 Sonoda et al.
2016/0083873 A1 * 3/2016 Kawabe ..... D02J 1/18 28/283

FOREIGN PATENT DOCUMENTS

JP 10-292238 A 11/1998
JP 11-156852 A 6/1999
JP 2002-255448 A 9/2002
JP 2004-100132 A 4/2004
JP 2011-241494 A 12/2011
JP 2013-49208 A 3/2013
JP 2013-525140 A 6/2013
JP 2014-30913 A 2/2014
JP 5512908 B1 6/2014
WO 2012/105080 A1 8/2012
WO 2013/057583 A2 4/2013

* cited by examiner

METHOD OF MANUFACTURING AND MANUFACTURING DEVICE FOR PARTIAL SPLIT-FIBER FIBER BUNDLE AND PARTIAL SPLIT-FIBER FIBER BUNDLE

TECHNICAL FIELD

This disclosure relates to a method of manufacturing and a manufacturing device for a partial split-fiber fiber bundle, and a partial split-fiber fiber bundle obtained by these manufacturing method and manufacturing device. More specifically, the disclosure relates to a method of manufacturing and a device for manufacturing a partial split-fiber fiber bundle in which an inexpensive large tow with a large number of single fibers, which is not supposed to be split, is enabled to be continuously split without causing yarn breakage, and a partial split-fiber fiber bundle obtained by these manufacturing method and manufacturing device.

BACKGROUND

A technology to produce a molded article having a desired shape is known in which a molding material composed of a bundle-like aggregate of discontinuous reinforcing fibers (for example, carbon fibers) (hereinafter, also referred to as fiber bundle) and a matrix resin is used and it is molded by heating and pressurizing. In such a molding material, a molding material comprising a fiber bundle having a large number of single fibers is excellent in flowability at the time of molding, but tends to be inferior in mechanical properties of a molded article. On the other hand, a fiber bundle adjusted to an arbitrary number of single fibers is used as a fiber bundle in the molding material, aiming to satisfy both the flowability at the time of molding and the mechanical properties of the molded article.

As a method of adjusting the number of single fibers of a fiber bundle, for example, JP 2002-255448 A and JP 2004-100132 A disclose methods of performing fiber splitting using a plurality of fiber bundle winding bodies prepared by winding a plurality of fiber bundles in advance. In those methods, however, because the number of single fibers of each fiber bundle treated in advance is restricted, the adjustment range is limited and, therefore, it is difficult to adjust to a desired number of single fibers.

Further, for example, JP 2013-49208 A, JP 2014-30913 A and Japanese Patent No. 5512908 disclose methods of longitudinally slitting a fiber bundle to a desired number of single fibers by using disk-shaped rotary blades. In those methods, although it is possible to adjust the number of single fibers by changing the pitch of the rotary blades, since the fiber bundle longitudinally slit over the entire length in the longitudinal direction has no convergence property, the yarn after the longitudinal slit tends to become difficult in handling such as winding it on a bobbin or unwinding the fiber bundle from the bobbin. In addition, when conveying the fiber bundle after the longitudinal slitting, the split end-like fiber bundle generated by the longitudinal slit may be wrapped around a guide roll, a feed roll or the like, which may not be easy to convey.

Further, WO 2012/105080 discloses a method of cutting a fiber bundle to a predetermined length at the same time as a longitudinal slit by a split-fiber cutter having a lateral blade perpendicular to the fiber direction in addition to a longitudinal blade having a longitudinal slit function in a direction parallel to the fiber direction. According to that method, it becomes unnecessary to once wind the fiber bundle after the longitudinal slit to the bobbin and transport it, and the handling property is improved. However, since the split-fiber cutter has the longitudinal blade and the lateral blade, when one of the blades reaches the cutting life first, an obstacle arises that the entire blade has to be exchanged.

As described above, to produce a molded article having fluidity and mechanical properties, a fiber bundle adjusted to an arbitrary number of single fibers is necessary.

Furthermore, in passing through the above-described longitudinal slit process at a state where a fiber bundle is twisted such as twist exists in the fiber bundle itself or twist occurs during traveling of the fiber bundle at the fiber splitting process, because crossing fiber bundles are cut in the longitudinal direction, a problem occurs in that the fiber bundle is cut at a small length before and after the longitudinal slitting process and the longitudinal slitting cannot be continuously performed.

Accordingly, it could be helpful to provide a method and a device for manufacturing a partial split-fiber fiber bundle capable of continuously and stably slitting a fiber bundle. In particular, it could be helpful to provide a method and a device for manufacturing a partial split-fiber fiber bundle enabling a continuous slitting without being concerned about the exchange life of a rotary blade even in a fiber bundle including twist or a fiber bundle of a large tow having a large number of single fibers, and a partial split-fiber fiber bundle obtained by such manufacturing method and manufacturing device.

SUMMARY

We thus provide:

(1) A method of manufacturing a partial split-fiber fiber bundle characterized in that, while a fiber bundle formed from a plurality of single fibers is traveled along the longitudinal direction thereof, a fiber splitting means provided with a plurality of protruding parts is pierced into the fiber bundle to create a split-fiber processed part, and entangled parts, where the single fibers are interlaced, are formed at contact parts with the protruding parts in at least one split-fiber processed part, thereafter the fiber splitting means is pulled out of the fiber bundle, and after passing through an entanglement accumulation part including the entangled parts, the fiber splitting means is once again pierced into the fiber bundle.

(2) A method of manufacturing a partial split-fiber fiber bundle characterized in that a fiber splitting means provided with a plurality of protruding parts is pierced into a fiber bundle formed from a plurality of single fibers, while the fiber splitting means is traveled along the longitudinal direction of the fiber bundle, a split-fiber processed part is created, and entangled parts, where the single fibers are interlaced, are formed at contact parts with the protruding parts in at least one split-fiber processed part, thereafter the fiber splitting means is pulled out of the fiber bundle, and after the fiber splitting means is traveled up to a position passing through an entanglement accumulation part including the entangled parts, the fiber splitting means is once again pierced into the fiber bundle.

(3) The method of manufacturing a partial split-fiber fiber bundle according to (1) or (2), wherein, after the fiber splitting means is pulled out of the fiber bundle, the fiber splitting means is once again pierced into the fiber bundle after a predetermined time passes.

(4) The method of manufacturing a partial split-fiber fiber bundle according to any of (1) to (3), wherein, after the fiber splitting means is pierced into the fiber bundle, the fiber splitting means is pulled out of the fiber bundle after a predetermined time passes.

(5) The method of manufacturing a partial split-fiber fiber bundle according to any of (1) to (4), wherein a pressing force acting on the protruding parts per a width of the fiber bundle at the contact parts is detected, and the fiber splitting means is pulled out of the fiber bundle accompanying an increase of the pressing force.

(6) The method of manufacturing a partial split-fiber fiber bundle according to any of (1) to (5), wherein an imaging means for detecting the presence of a twist of the fiber bundle in a range of 10 to 1,000 mm in at least one of the front and rear of the fiber bundle along the longitudinal direction of the fiber bundle from the fiber splitting means having been pierced into the fiber bundle is further provided.

(7) The method of manufacturing a partial split-fiber fiber bundle according to (6), wherein a pressing force acting on the protruding parts per a width of the fiber bundle at the contact parts is detected, a twist is detected by the imaging means, and the fiber splitting means is controlled so that the pressing force is reduced until the protruding parts are passed through the twist from immediately before being contacted with the twist.

(8) The method of manufacturing a partial split-fiber fiber bundle according to any of (1) to (7), wherein each of the plurality of protruding parts can be controlled independently.

(9) The method of manufacturing a partial split-fiber fiber bundle according to any of (1) to (8), wherein the fiber splitting means has a rotational shaft orthogonal to the longitudinal direction of the fiber bundle, and the protruding parts are provided on a surface of the rotational shaft.

(10) The method of manufacturing a partial split-fiber fiber bundle according to any of (1) to (9), wherein the fiber bundle comprises reinforcing fibers.

(11) The method of manufacturing a partial split-fiber fiber bundle according to (10), wherein the reinforcing fibers are carbon fibers.

(12) A device for manufacturing a partial split-fiber fiber bundle, which splits a fiber bundle formed from a plurality of single fibers into a plurality of bundles, comprising at least: a feeding means for feeding the fiber bundle; a fiber splitting means having a plurality of protruding parts each splitting the fiber bundle; a control means for piercing/pulling out the fiber splitting means into/from the fiber bundle; and a winding means for winding up a partial split-fiber fiber bundle having been split.

(13) The device for manufacturing a partial split-fiber fiber bundle according to (12), further comprising a rotation mechanism for making the fiber splitting means rotatable along a rotation axis orthogonal to the feeding direction of the fiber bundle.

(14) The device for manufacturing a partial split-fiber fiber bundle according to (12) or (13), further comprising a pressing force detection means for detecting a pressing force from the fiber bundle at the protruding parts pierced into the fiber bundle, and a pressing force calculation means for calculating a pressing force having been detected and pulling out the fiber splitting means from the fiber bundle by the control means.

(15) The device for manufacturing a partial split-fiber fiber bundle according to any of (12) to (14), further comprising an imaging means for detecting the presence of a twist of the fiber bundle in a range of 10 to 1,000 mm in at least one of the front and rear of the fiber bundle along the longitudinal direction of the fiber bundle from the fiber splitting means having been pierced into the fiber bundle.

(16) A partial split-fiber fiber bundle characterized in that a split-fiber processed section, in which a fiber bundle formed from a plurality of single fibers is split into a plurality of bundles along the longitudinal direction of the fiber bundle, and a split-fiber unprocessed section, are formed alternately.

(17) The partial split-fiber fiber bundle according to (16), wherein an entangled part where the single fibers are interlaced, and/or, an entanglement accumulation part where the entangled part is accumulated, is formed in at least one end portion of at least one split-fiber processed section.

(18) The partial split-fiber fiber bundle according to (17), wherein an entanglement accumulation part including an entangled part where the single fibers are interlaced is formed in at least one end portion of the split-fiber processed section.

(19) The partial split-fiber fiber bundle according to any of (16) to (18), wherein a plurality of alternately formed split-fiber processed sections and split-fiber unprocessed sections are provided in parallel in the width direction of the fiber bundle, and the split-fiber processed sections are randomly provided in the fiber bundle.

(20) The partial split-fiber fiber bundle according to any of (16) to (18), wherein a plurality of alternately formed split-fiber processed sections and split-fiber unprocessed sections are provided in parallel in the width direction of the fiber bundle, and in an entire width region of an arbitrary length in the longitudinal direction of the fiber bundle, at least one split-fiber processed section is provided.

It is possible to provide a method and a device for manufacturing a partial split-fiber fiber bundle capable of continuously and stably slitting a fiber bundle. In particular, it is possible to provide a method and a device for manufacturing a partial split-fiber fiber bundle enabling a continuous slitting without being concerned about the exchange life of a rotary blade even in a fiber bundle including twist or a fiber bundle of a large tow having a large number of single fibers, and a partial split-fiber fiber bundle obtained by such a manufacturing method and manufacturing device. Further, it is possible to perform a continuous slitting of an inexpensive large tow, and reduce the material cost and manufacturing cost of a molded article.

EXPLANATION OF SYMBOLS

Figure 1:
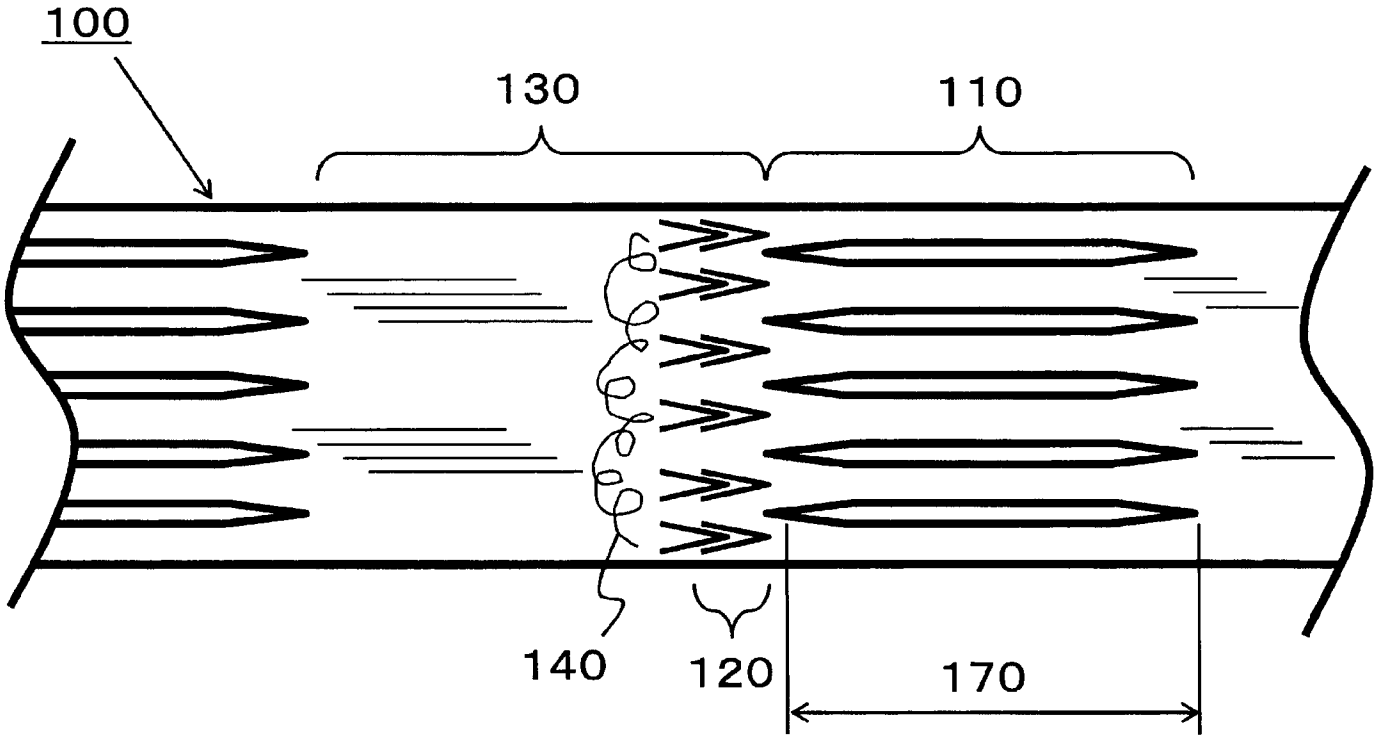
FIG. 1 is a schematic plan view showing an example of a partial split-fiber fiber bundle performed with fiber splitting to a fiber bundle.

100: fiber bundle
110, 110*a*, 110*b*, 111*a*, 111*b*, 111*c*, 111*d*, 112*a*, 112*b*, 113*a*, 113*b*, 113*c*, 113*d*, 114*a*,
115*a*, 116*a*, 116*b*, 117*a*, 118*a*: split-fiber processed part
120, 830: entanglement accumulation part
130: split-fiber unprocessed part
140: fluff pool
150: split-fiber processed part
160: entangled part
170: length of fiber splitting
200: fiber splitting means
210: protruding part
211: contact part
220: rotating fiber splitting means
230L, 230R: corner portion
240: rotation axis
300: twisted part
310, 320: single fiber contained in fiber bundle
810, 820, 821: arbitrary length region in longitudinal direction of partial split-fiber fiber bundle

DETAILED DESCRIPTION

Method and Device as a Whole

Hereinafter, our methods and devices will be explained with reference to the drawings. This disclosure is not limited in any way to the examples shown in the drawings.

Figure 2A:
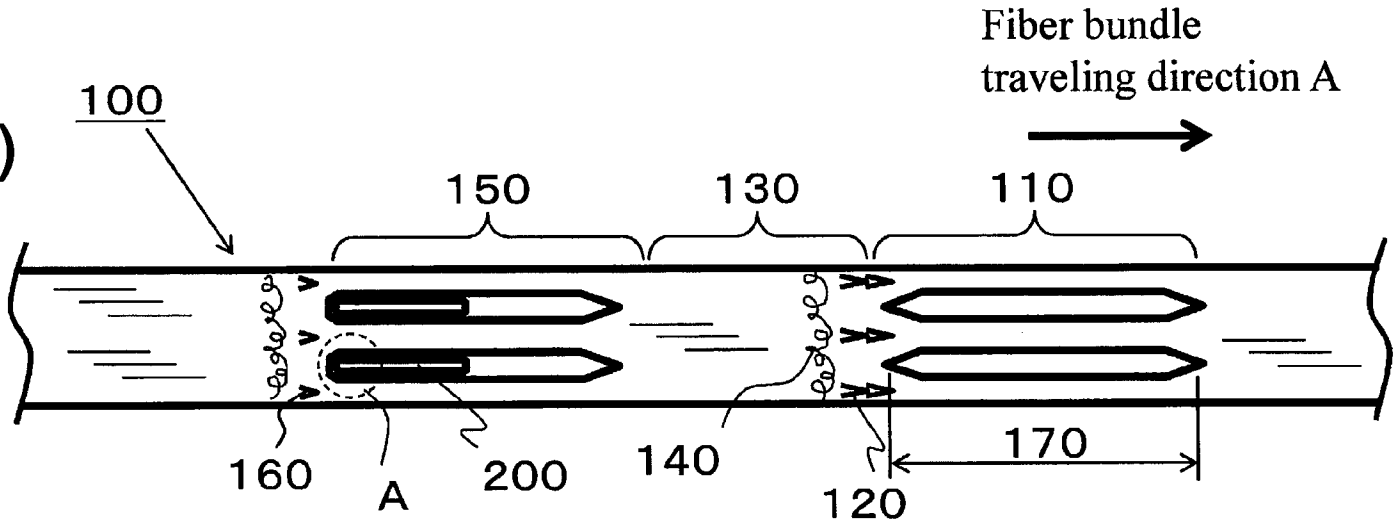
FIGS. 2(A) and 2(B) show (A) a schematic plan view and (B) a schematic side view, respectively showing an example in which a fiber splitting means is pierced into a traveling fiber bundle.
Figure 2B:
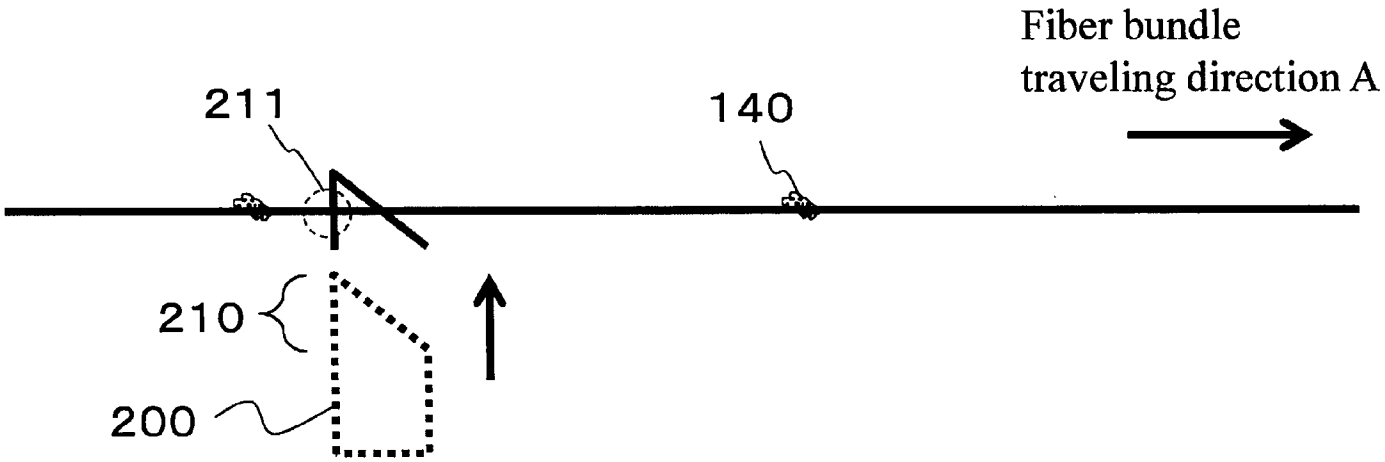

FIG. 1 shows an example of a partial split-fiber fiber bundle performed with fiber splitting to a fiber bundle, and FIGS. 2(A) and 2(B) show an example of the fiber splitting. A method and a device for manufacturing a partial split-fiber fiber bundle will be explained using FIGS. 2(A) and 2(B). FIGS. 2(A) and 2(B) show (A) a schematic plan view and (B) a schematic side view, showing an example in which a fiber splitting means is pierced into a traveling fiber bundle. In the figures, a fiber bundle traveling direction A (arrow) is the longitudinal direction of a fiber bundle 100, which shows that the fiber bundle 100 is continuously supplied from a fiber bundle supply device (not shown).

A fiber splitting means 200 has a protruding part 210 having a protruding shape which is easy to be pierced into the fiber bundle 100, and which is pierced into the traveling fiber bundle 100 to create a split-fiber processed part 150 approximately parallel to the longitudinal direction of the fiber bundle 100. It is preferred that the fiber splitting means 200 is pierced to the side surface of the fiber bundle 100. The side surface of the fiber bundle means a surface in the horizontal direction when the section of the fiber bundle is a flat shape such as a horizontally long elliptical shape or a horizontally elongated rectangular shape (for example, corresponding to the side surface of the fiber bundle 100 shown in FIG. 2(A)). Further, the number of protruding parts 210 to be provided may be one for each single fiber splitting means 200 or may be plural. When there are a plurality of protruding parts 210 in one fiber splitting means 200, because the abrasion frequency of the protruding part 210 decreases, it becomes possible to reduce the frequency of exchange. Furthermore, it is also possible to simultaneously use a plurality of fiber splitting means 200 depending upon the number of fiber bundles to be split. It is possible to arbitrarily dispose a plurality of protruding parts 210 by arranging a plurality of fiber splitting means 200 in parallel, staggeringly, in shifted phases or the like.

When the fiber bundle 100 formed from a plurality of single fibers is divided into fiber-split bundles of a smaller number of fibers by the fiber splitting means 200, since the plurality of single fibers are substantially not aligned in the fiber bundle 100 and there are many portions interlaced at the single fiber level, entangled parts 160, in which the single fibers are interlaced in the vicinity of the contact parts 211 during the fiber splitting, can be formed.

Forming the entangled part 160 means, for example, forming (moving) the entanglement of single fibers with each other, which was previously present in the split-fiber processed section, on the contact part 211 by the fiber splitting means 200, forming (producing) an aggregate, in which single fibers are newly entangled, by the fiber splitting means 200, and the like.

After creating the split-fiber processed part 150 in an arbitrary range, the fiber splitting means 200 is pulled out from the fiber bundle 100. By this pulling out, a split-fiber processed section 110 performed with fiber splitting is created and, at the same time as that, an entanglement accumulation part 120 accumulated with the entangled parts 160 is created. Further, fluffs generated from the fiber bundle during the fiber splitting are formed as a fluff pool 140 near the entanglement accumulation part 120 at the time of the fiber splitting.

Thereafter, a split-fiber unprocessed section 120 is created by once again piercing the fiber splitting means 200 into the fiber bundle 100.

The traveling speed of the fiber bundle is preferably a stable speed with little fluctuation, more preferably a constant speed.

The fiber splitting means 200 is not particularly restricted as long as it is within a desired range, and it is preferably one having a shape like a sharp shape such as a metal needle or a thin plate. With respect to the fiber splitting means 200, it is preferred that a plurality of fiber splitting means 200 are provided in the width direction of the fiber bundle 100 to be subjected to the fiber splitting, and the number of the fiber splitting means 200 can be arbitrarily selected depending upon the number F of single fibers forming the fiber bundle 100 to be subjected to the fiber splitting. The number of the fiber splitting means 200 is preferably (F/10000−1) or more and less than (F/50−1) with respect to the width direction of the fiber bundle 100. If it is less than (F/10000−1), improvement of mechanical properties is difficult to be developed when made into a fiber reinforced composite material in a following process, and when it is (F/50−1) or more, there is a possibility of occurrence of yarn breakage or fluffs at the time of the fiber splitting.

Fiber Bundle

The fiber bundle 100 is not particularly limited in fiber kind as long as it is a fiber bundle composed of a plurality of single fibers. In this connection, it is preferred to use reinforcing fibers, and in particular, the kind thereof is preferably at least one selected from the group consisting of carbon fibers, aramide fibers and glass fibers. These may be used solely, or two or more of them can be used together. Among those, carbon fibers are particularly preferable because it is possible to provide a composite material light in weight and excellent in strength. As the carbon fibers, any one of PAN type and pitch type may be used, and the average fiber diameter thereof is preferably 3 to 12 and more preferably 6 to 9 μm.

In carbon fibers, usually, a fiber bundle obtained by bundling about 3,000 to 60,000 single fibers made of continuous fibers is supplied as a wound body (package) wound around a bobbin. Although it is preferred that the fiber bundle is untwisted, it is also possible to use a twisted strand, and it is applicable even if twisting occurs during conveyance. There is no restriction on the number of single fibers, and when a so-called large tow having a large number of single fibers is used, since the price per unit weight of the fiber bundle is inexpensive, as the number of single yarns increases, the cost of the final product can be reduced, and such a condition is preferred. Further, as a large tow, a so-called doubling form in which fiber bundles are wound together in a form of one bundle may be employed.

When reinforcing fibers are used, it is preferred that they are surface treated for the purpose of improving the adhesive property with a matrix resin used when made to a reinforcing fiber composite material. As methods of the surface treatment, there are an electrolytic treatment, an ozone treatment, a ultraviolet treatment and the like. Further, a sizing agent may be applied for the purpose of preventing fluffing of the reinforcing fibers, improving convergence property of the reinforcing fiber strand, improving adhesive property with the matrix resin, and the like. As the sizing agent, although not particularly limited, a compound having a functional group such as an epoxy group, a urethane group, an amino group, a carboxyl group or the like can be used and, as such a compound, one type or a combination of two or more types may be used.

The fiber bundle is preferably in a state of being bundled in advance. The state of being bundled in advance indicates, for example, a state in which the single fibers forming the fiber bundle are bundled by entanglement with each other, a state in which the fibers are converged by a sizing agent applied to the fiber bundle, or a state in which the fibers are converged by twist generated in a process of manufacturing the fiber bundle.

Movement of Fiber Splitting Means

Figure 5A:
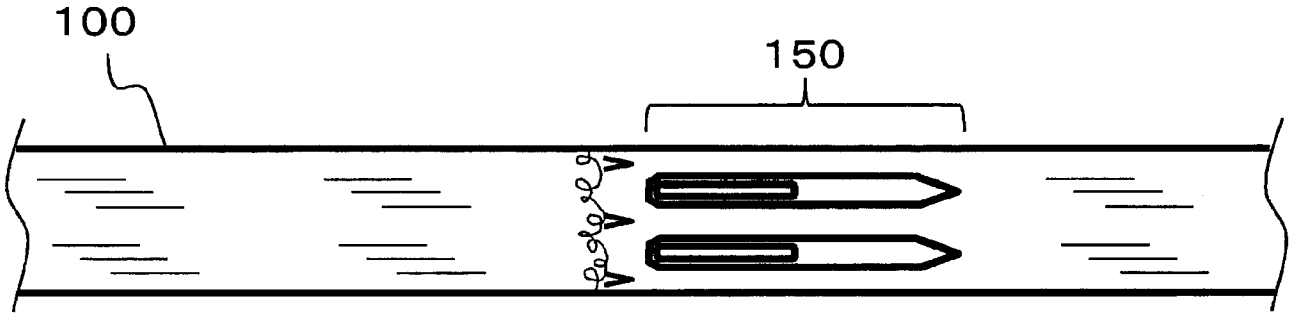
FIGS. 5(A) and 5(B) show (A) a schematic plan view and (B) a schematic side view, respectively showing an example of a movement cycle in which a moving fiber splitting means is pierced into a fiber bundle.
Figure 5B:
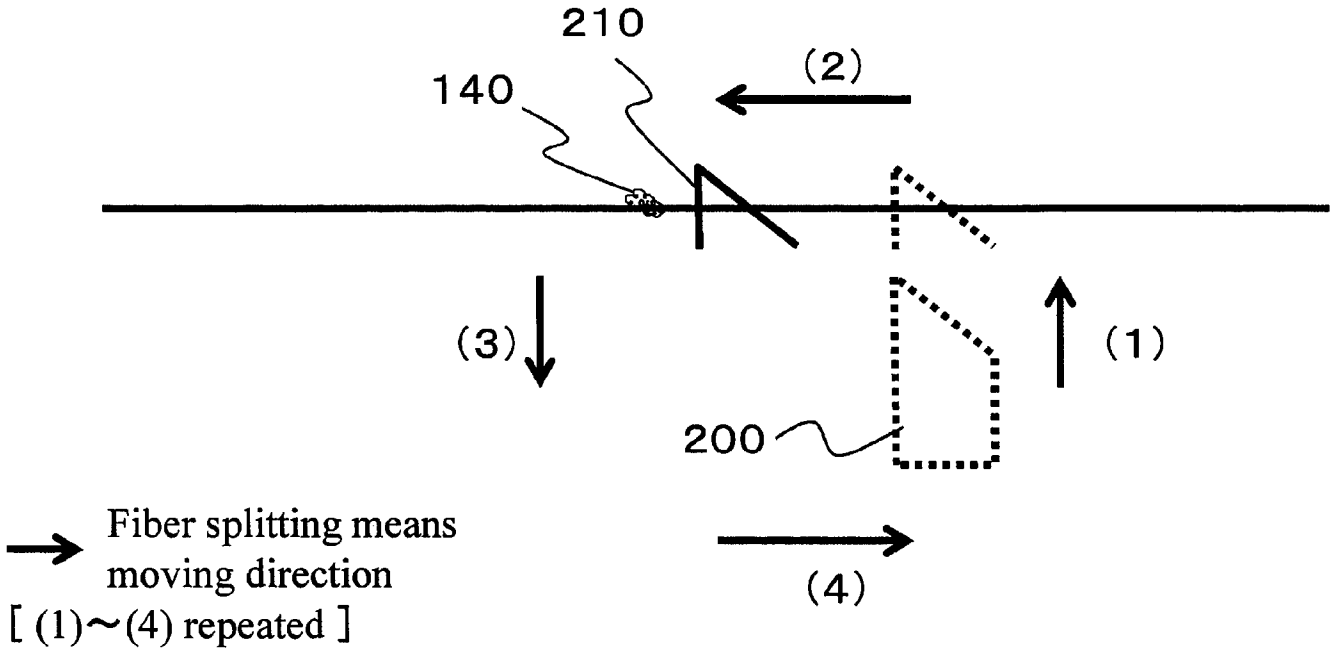
Figure 6A:
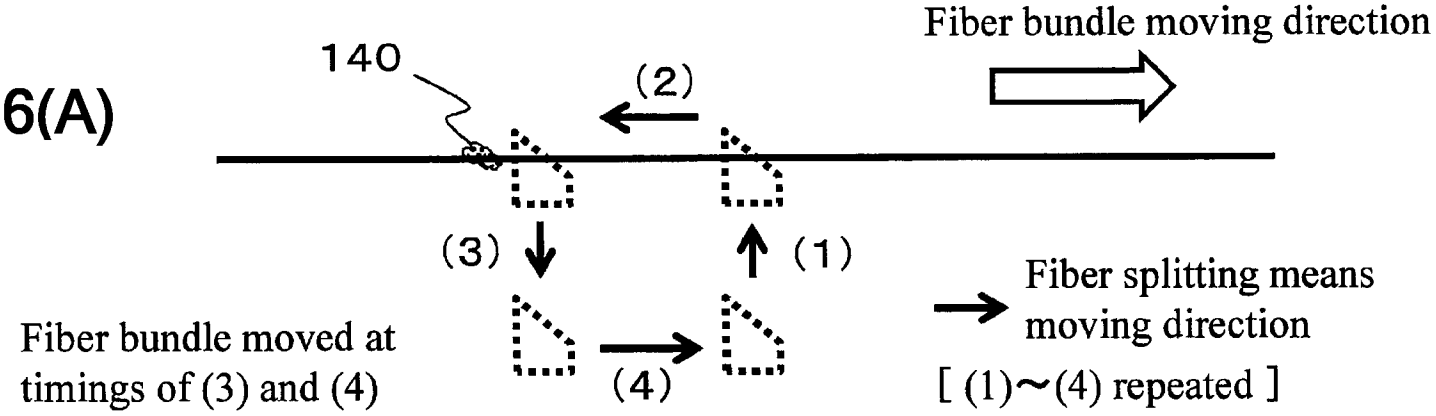
FIGS. 6(A) and 6(B) show schematic explanatory views showing another example of a movement cycle in which a moving fiber splitting means is pierced into a fiber bundle.
Figure 6B:
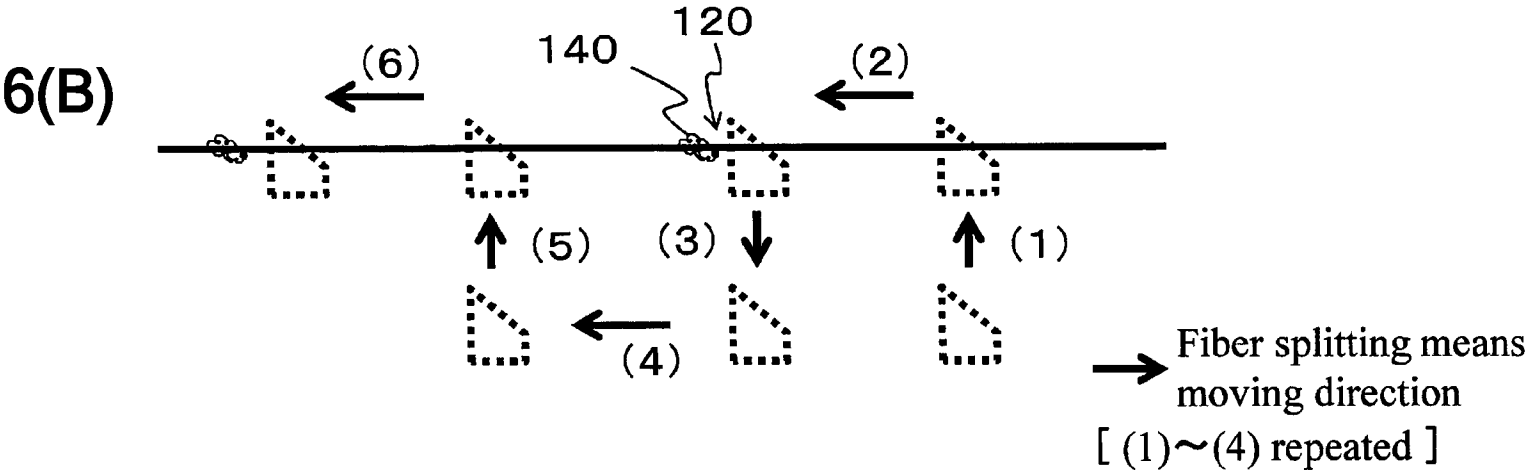

Our methods and devices are not limited to when the fiber bundle travels and, as shown in FIGS. 5(A) and 5(B), a method may be also employed wherein the fiber splitting means 200 is pierced into the fiber bundle 100 being in a stationary state (arrow (1)), then while the fiber splitting means 200 is traveled along the fiber bundle 100 (arrow (2)), the split-fiber processed part 150 is created and, thereafter, the fiber splitting means 200 is pulled out (arrow (3)). Thereafter, as shown in FIG. 6(A), the fiber splitting means 200 may be returned to the original position (arrow (4)) after the fiber bundle 100 having been in a stationary state is moved by a constant distance, or as shown in FIG. 6(B), without moving the fiber bundle 100, the fiber splitting means 200 may be traveled until it passes through the entanglement accumulation part 120 (arrow (4)).

Thus, by the fiber splitting means 200, a split-fiber processed section and a split-fiber unprocessed section are formed alternately.

Depending upon the entanglement state of single fibers forming the fiber bundle 100, without securing a split-fiber unprocessed section having an arbitrary length (for example, in FIG. 2(A), after creating the split-fiber processed section 110, creating a next split-fiber processed part 150 without securing a split-fiber unprocessed section 130 having a constant length), it is possible to restart fiber splitting continuously from the vicinity of the terminal end portion of the split-fiber processed section. For example, as shown in FIG. 6(A), when the fiber splitting is performed while intermittently moving the fiber bundle 100, after the fiber splitting means 200 performs the fiber splitting (arrow (2)), by setting the moving length of the fiber bundle 100 to be shorter than the length of the fiber splitting performed immediately before, the position (arrow (1)) where the fiber splitting means 200 is to be pierced once again can be overlapped with the split-fiber processed section performed with fiber splitting performed immediately before. On the other hand, as shown in FIG. 6(B), in carrying out the fiber splitting while moving the fiber splitting means 200 itself, after once pulling out the fiber splitting means 200 (arrow (3)), without moving it at a constant length (arrow (4)), the fiber splitting means 200 can be pierced into the fiber bundle again (arrow (5)).

In such a fiber splitting, when a plurality of single fibers forming the fiber bundle 100 are interlaced with each other, since the single fibers are not substantially aligned in the fiber bundle, even if the fiber splitting means 200 is pierced again at the same position as the position where the fiber splitting has been already performed or as the position where the fiber splitting means has been pulled out, in the width direction of the fiber bundle 100, the position to be pierced is easily shifted with respect to the single fiber level, and the split-fiber state (gap) is not continued from the split-fiber processed section formed immediately before and they can be made to exist as split-fiber processed sections separated from each other.

The length of the split-fiber processed section 170 obtained per one fiber splitting is preferably 1 mm or more and less than 5,000 mm, although it depends upon the entanglement state of single fibers of the fiber bundle performed with the fiber splitting. If it is less than 1 mm, the effect according to the fiber splitting is insufficient, and if it is 5,000 mm or more, depending upon the reinforcing fiber bundle, there is a possibility of occurrence of yarn breakage or fuzzing. More preferably it is 10 mm or more and less than 3,000 mm, and further preferably 30 mm or more and less than 1,000 mm.

Further, when a plurality of fiber splitting means 200 are provided, it is also possible to provide a plurality of alternately formed split-fiber processed sections and split-fiber unprocessed sections approximately parallel to the width direction of the fiber bundle. In this case, as aforementioned, it is possible to arbitrarily dispose a plurality of protruding parts 210 by arranging a plurality of fiber splitting means 200 in parallel, staggeringly, in shifted phases or the like.

Furthermore, each of the plurality of protruding parts 210 can also be controlled independently. Although the details will be described later, it is also preferred that the individual protruding parts 210 independently perform fiber splitting by the time required for the fiber splitting or the pressing force detected by the protruding part 210.

Unwinding

In any case, the fiber bundle is unwound from an unwinding device (not shown) or the like disposed on the upstream side in the fiber bundle traveling direction for unwinding the fiber bundle. As the unwinding direction, although a laterally unwinding system for pulling out in a direction perpendicular to the axis of rotation of a bobbin and a longitudinally unwinding system for pulling out in the same direction as the axis of rotation of the bobbin (paper tube) are considered, the laterally unwinding system is preferred in consideration that in that system there are few unwinding twists.

Further, with respect to the installation posture of the bobbin at the time of unwinding, it can be installed in an arbitrary direction. In particular, when, in a state where the bobbin is pierced through the creel, the end surface of the bobbin on the side not being the creel rotation shaft fixed surface is directed in a direction other than the horizontal direction, it is preferred that the fiber bundle is held in a state where a constant tension is applied to the fiber bundle. When there is no constant tension in the fiber bundle, it is considered that the fiber bundle falls from and is separated from a package (a winding body in which the fiber bundle is wound on the bobbin), or that a fiber bundle separated from the package winds around the creel rotation shaft and unwinding becomes difficult.

Further, as a method of fixing the rotation shaft of the unwound package, in addition to the method of using a creel, a surface unwinding method is also applicable wherein a package is placed on two rollers arranged with each other in parallel with the two parallel rollers, and the package is rolled on the arranged rollers to unwind a fiber bundle.

Further, in unwinding using a creel, a method of applying a tension to the unwound fiber bundle by applying a brake to the creel by putting a belt around the creel, fixing one end of the belt, and hanging the weight or pulling with a spring at the other end or the like, is considered. In this case, varying the braking force depending upon the winding diameter is effective as a means of stabilizing the tension.

Furthermore, to adjust the number of single fibers after fiber splitting, a method of widening the fiber bundle and a method of adjusting by a pitch of a plurality of fiber splitting means arranged in the width direction of the fiber bundle can be employed. By making the pitch of the fiber splitting means smaller and providing a larger number of fiber splitting means in the width direction of the fiber bundle, it becomes possible to perform a so-called thin bundle fiber splitting into thin bundles with fewer single fibers. Further, it is also possible to adjust the number of single fibers even by widening the fiber bundle before fiber splitting and performing fiber splitting of the widened fiber bundle with a larger number of fiber splitting means without narrowing the pitch of the fiber splitting means.

The term "widening" means a processing of expanding the width of the fiber bundle 100. The widening method is not particularly restricted, and it is preferred to use a vibration widening method of passing through a vibration roll, an air widening method of blowing compressed air, or the like.

Piercing, Pulling Out: Time

The split-fiber processed part 150 is formed by repeating piercing and pulling out of the fiber splitting means 200. At that time, it is preferred to set the timing of piercing again by the time passed after pulling out the fiber splitting means 200. Further, also it is preferred to set the timing of pulling out again by the time passed after piercing the fiber splitting means 200. By setting the timing of piercing thrusting and/or pulling out with time, it becomes possible to create the split-fiber processed section 110 and the split-fiber unprocessed section 130 at predetermined distance intervals, and it also becomes possible to arbitrarily determine the ratio between the split-fiber processed section 110 and the split-fiber unprocessed section 130. Further, although the predetermined time intervals may be always the same, it is also possible to change the intervals in accordance with circumstances, such as increasing or shortening the intervals depending upon the distance at which the fiber splitting has been progressed, or changing the intervals depending upon the state of the fiber bundle at respective times, for example, shortening the predetermined time intervals when there is little fluffing or entanglement of single fibers in the original fiber bundle, or the like.

Pulling Out: Pressing Force, Tension, or Difference in Tension

When the fiber splitting means 200 is pierced into the fiber bundle 100, since the created entangled part 160 continues to press the protruding part 210 in accordance with the course of the fiber splitting, the fiber splitting means 200 receives a pressing force from the entangled part 160.

As aforementioned, a plurality of single fibers are not substantially aligned in the fiber bundle 100 but in most portions they are interlaced with each other at the single fiber level and, further, in the longitudinal direction of the fiber bundle 100, there is a possibility where there exists a portion with many entanglements and a portion with few entanglements. In the portion with many entanglements of single fibers, the rise of the pressing force at the time of fiber splitting becomes fast and, conversely, in the portion with few entanglements of single fibers, the rise of the pressing force becomes slow. Therefore, it is preferred that the fiber splitting means 200 is provided with a pressing force detection means that detects a pressing force from the fiber bundle 100.

Further, since the tension of the fiber bundle 100 may change before and after the fiber splitting means 200, at least one tension detection means that detects the tension of the fiber bundle 100 may be provided in the vicinity of the fiber splitting means 200, or a plurality of them may be provided and a difference in tension may be calculated. These means that detect the pressing force, the tension and the tension difference may be provided individually, or may be provided in a form of any combination thereof. The tension detection means that detects the tension is disposed preferably 10 to 1,000 mm apart from the fiber splitting means 200 in at least one of the front and rear of the fiber bundle 100 along the longitudinal direction of the fiber bundle 100.

It is preferred that the pulling out of the fiber splitting means 200 is controlled in accordance with each detected value of these pressing force, tension and tension difference. It is further preferred to control by pulling out the fiber splitting means 200 when the detected value exceeds an arbitrarily set upper limit value accompanying with the rise of the detected value. In the pressing force and the tension, it is preferred to set the upper limit value to 0.01 to 1 N/mm, and in the tension difference 0.01 to 0.8 N/mm. The upper limit value may be varied within a range of ±10% depending upon the state of the fiber bundle. The unit (N/mm) of the pressing force, the tension and the tension difference indicates force acting per the width of the fiber bundle 100.

If lower than the range of the upper limit value of the pressing force, the tension or the tension difference, because immediately after piercing the fiber splitting means 200 the pressing force, the tension or the tension difference reaches a value to be pulled out with the fiber splitting means 200, a sufficient fiber splitting distance cannot be obtained, the split-fiber processed section 110 becomes too short, and therefore, the fiber bundle performed with fiber splitting to be obtained cannot be obtained. On the other hand, if exceeding the range of the upper limit value, because after piercing the fiber splitting means 200 cutting of the single fibers in the fiber bundle 100 increases before the pressing force, the tension or the tension difference reaches a value to be pulled out with the fiber splitting means 200, defects such as projecting of the fiber bundle having been performed with fiber splitting in a shape like a split end or increase of generated fluffs, are likely to occur. The projected split end may be wrapped around a roll being served to the conveyance, or the fluffs are accumulated on a drive roll to cause slipping in the fiber bundle and the like and, thus, a conveyance failure tends to be caused.

Differently from when the timing of pulling out of the fiber splitting means 200 is controlled over time, in detecting the pressing force, the tension and the tension difference, because the fiber splitting means 200 is pulled out before enough force to cut the fiber bundle 100 is applied during the fiber splitting, an unreasonable force is not applied to the fiber bundle 100, and continuous fiber splitting becomes possible.

Furthermore, to obtain the fiber bundle 100 having a long split-fiber processed section 110 and a stable shape of the entanglement accumulation part 120 in the longitudinal direction, while suppressing the occurrence of branching or fuzzing like a partial cutting of the fiber bundle 100, it is preferred that the pressing force is controlled to 0.04 to 0.4 N/mm, the tension is controlled to 0.02 to 0.2 N/mm, and the tension difference is controlled to 0.05 to 0.5 N/mm.

Image Detection

It is also preferred to provide an imaging means to detect the presence of a twist of the fiber bundle 100 in a range of 10 to 1,000 mm in at least one of the front and rear of the fiber bundle 100 along the longitudinal direction of the fiber bundle 100 from the fiber splitting means 200 having been pierced into the fiber bundle 100. By this imaging, the position of the twist is specified beforehand, and it is controlled not to pierce the fiber splitting means 200 into the twist, thereby making it possible to prevent a mistake in piercing. Further, by pulling out the fiber splitting means 200 when the twist approaches the pierced fiber splitting means 200, that is, by controlling not to pierce the fiber splitting means 200 into the twist, it is possible to prevent narrowing in width of the fiber bundle 100. A mistake in piercing means that the fiber splitting means 200 is pierced into the twist, the fiber bundle 100 is only pushed and moved in the piercing direction of the fiber splitting means 200, and the fiber splitting is not performed.

In a configuration in which a plurality of fiber splitting means 200 are present in the width direction of the fiber bundle 100 and are arranged at equal intervals, if the width of the fiber bundle 100 varies, because the number of single fibers having been performed with fiber splitting also varies, there is a possibility that a fiber splitting with a stable number of single fibers cannot be performed. Further, if the twist is forcibly performed with fiber splitting, because the fiber bundle 100 is cut at the single fiber level to generate a large amount of fluffs, the shape of the entanglement accumulation part 120 in which the entangled parts 160 are accumulated becomes large. If the large entanglement accumulation part 120 is left, it is easily caught by the fiber bundle 100 unwound from the roll.

Twisted Part Avoidance by Fast Forward

When the twist of the fiber bundle 100 is detected, other than the above-described control not to pierce the fiber splitting means 200 into the twist, the traveling speed of the fiber bundle 100 may be changed. Concretely, after the twist is detected, the traveling speed of the fiber bundle 100 is increased at the timing when the fiber splitting means 200 is being pulled out from the fiber bundle 100 until the twist passes through the fiber splitting means 200, thereby efficiently avoiding the twist.

Narrowing in Width

Figure 10A:
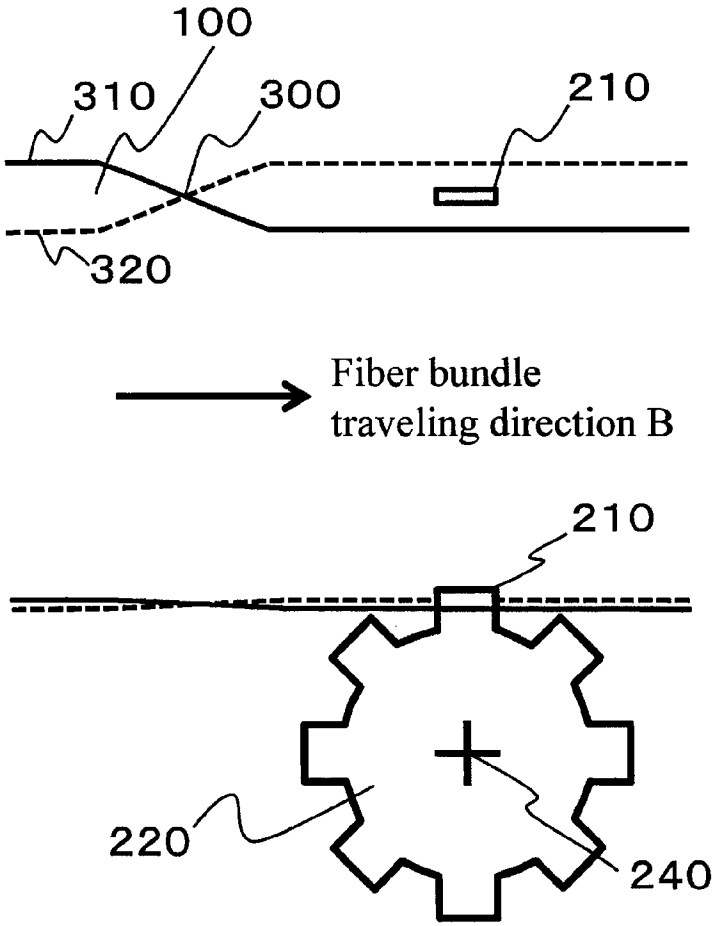
FIGS. 10(A) and 10(B) show schematic explanatory views showing (A) a state before fiber splitting performed at a twisted portion and (B) a state showing that the width of a fiber bundle becomes narrower after fiber splitting performed at the twisted portion.
Figure 10B:
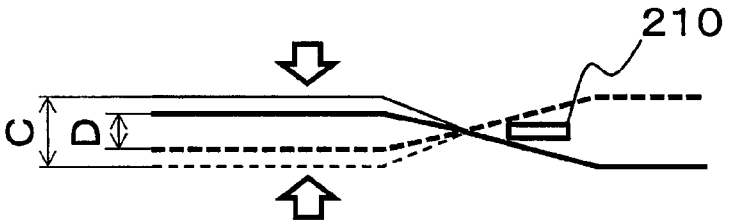

The narrowing in width of the fiber bundle 100 will be explained using FIGS. 10(A) and 10(B). FIGS. 10(A) and 10(B) show an example of the drawing using a rotating fiber splitting means 220, and the form of the fiber splitting means is not limited thereto. FIG. 10(A) shows a state in which the protruding part 210 is pierced into the fiber bundle 100 and the fiber splitting is being performed when the fiber bundle 100 is being traveled along the fiber bundle traveling direction B. In this state, the twisted part 300 is not in contact with the protruding part 210. A solid line 310 and a one-dot chain line 320 in FIG. 10(A) each indicate a single fiber in the fiber bundle 100. The positions of these single fibers 310, 320 are switched with the twist portion 300 as a boundary. When the fiber bundle 100 is traveled and the fiber splitting is performed at a condition where the protruding part 210 is brought into contact with the twisted part 300 as it is, as shown in FIG. 10(B), the width of the fiber bundle is narrowed from C to D. Although, when the reference symbols 310 and 320 are single fibers is explained, not limited to this example, and the same manner is also applied to when the twisted part 300 is formed in a fiber bundle state in which a certain amount of single fibers are collected.

Change of Pressing

An image calculation processing means to calculate the image obtained by the imaging means may be further provided, and a pressing force control means to control the pressing force of the fiber splitting means 200 based on the calculation result of the image calculation processing means may be further provided. For example, when the image processing means detects a twist, it is possible to improve the passing ability of the twist when the fiber splitting means passes the twist. Concretely, it is preferred to detect the twist by the imaging means and control the fiber splitting means 200 so that the pressing force is decreased from just before the protruding part 210 comes into contact with the detected twist to the time when the protruding part 210 passes therethrough. When the twist is detected, it is preferred to reduce it to 0.01 to 0.8 times the upper limit value of the pressing force. When it is below this range, substantially the pressing force cannot be detected, it becomes difficult to control the pressing force, or it becomes necessary to enhance the detection accuracy of the control device itself. Further, when it exceeds this range, the frequency of the fiber splitting performed to the twist is increased and the fiber bundle becomes narrow.

Rotating Fiber Splitting Means

Figures 7A, 7B, 7C:
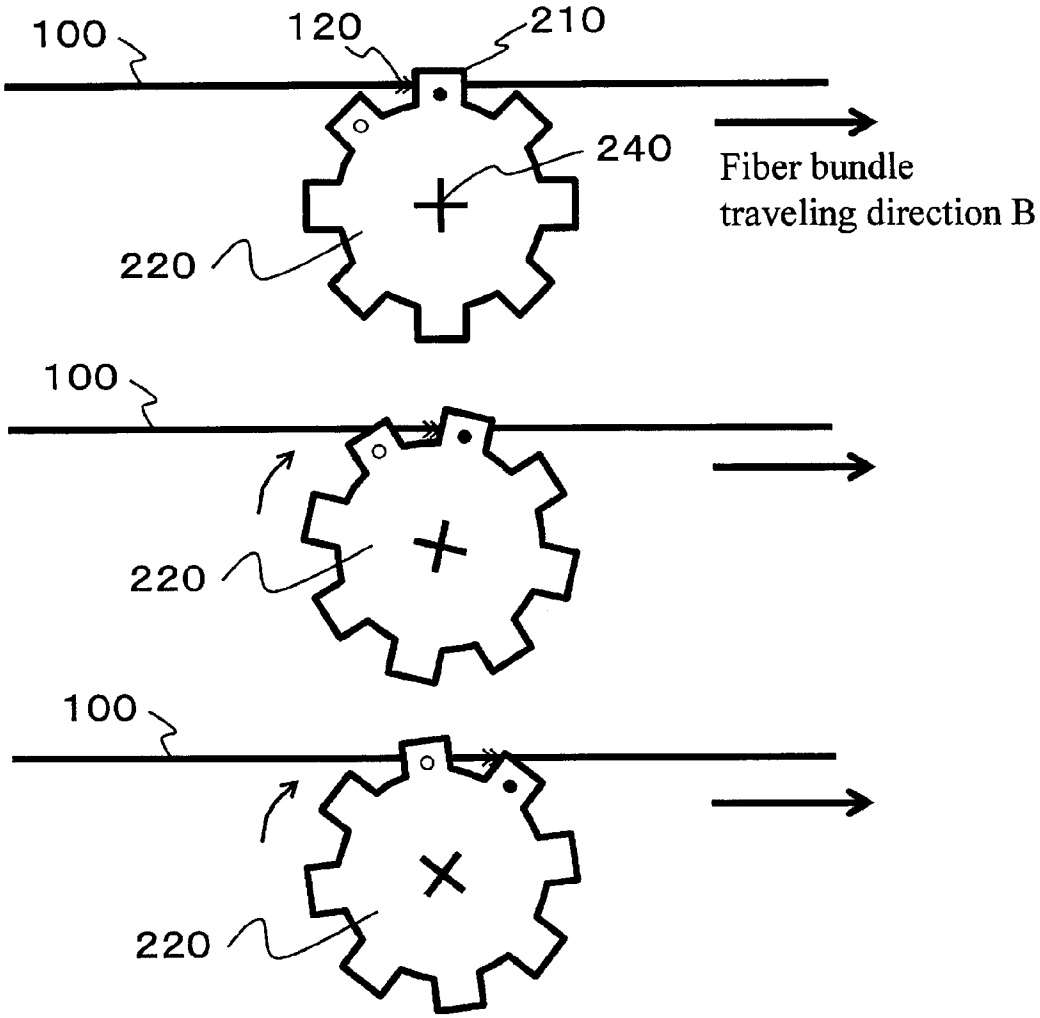
FIGS. 7(A), 7(B) and 7(C) show explanatory views showing an example of a movement cycle in which a rotating fiber splitting means is pierced.

It is also a preferred example to use a rotating fiber splitting means 220 rotatable as the fiber splitting means other than simply piercing the fiber splitting means 200 having the protruding part 210 into the fiber bundle 100. FIGS. 7(A) to 7(C) are an explanatory view showing an example of a movement cycle in which a rotating fiber splitting means is pierced. The rotating fiber splitting means 220 has a rotation mechanism having a rotation axis 240 orthogonal to the longitudinal direction of the fiber bundle 100, and the protruding part 210 is provided on the surface of the rotation shaft 240. As the fiber bundle 100 travels along the fiber bundle traveling direction B (arrow) in the figures, the protruding parts 210 provided in the rotating fiber splitting means 220 are pierced into the fiber bundle 100 and the fiber splitting is started. Although not shown in the drawings, it is preferred that the rotating fiber splitting means 220 has a pressing force detection mechanism and a rotation stop position holding mechanism. Until a predetermined pressing force acts on the rotating fiber splitting means 220 by the both mechanisms, the rotation stop position is maintained at the position shown in FIG. 7(A) and the fiber splitting is continued. When the predetermined pressing force is exceeded, for example, an entangled part 160 is caused at the protruding part 210, the rotating fiber splitting means 220 starts to rotate as shown in FIG. 7(B). Thereafter, as shown in FIG. 7(C), the protruding part 210 (black circle mark) is pulled out from the fiber bundle 100, and the protruding part 210 (white circle mark) is pierced into the fiber bundle 100. The shorter the operation shown in FIGS. 7(A) to 7(C) is, the shorter the split-fiber unprocessed section becomes, and therefore, when it is attempted to increase the proportion of split-fiber processed sections, it is preferred to shorten the operation shown in FIGS. 7(A) to 7(C).

Twisted Part Avoidance by Fast Rotation

By arranging the protruding parts 210 more in the rotating fiber splitting means 220, it is possible to obtain a fiber bundle 100 with a high proportion of fiber splitting and to extend the life of the rotating fiber splitting means 220. A fiber bundle with a high proportion of fiber splitting is a fiber bundle obtained by lengthening the fiber-splitting length within the fiber bundle, or a fiber bundle in which the frequency of occurrence of the section subjected to the fiber splitting processing and the split-fiber unprocessed section is increased. Further, as the number of the protruding parts 210 provided in one rotating fiber splitting means increases, the lifetime can be lengthened by reducing the frequency of contact of the protruding parts 210 with the fiber bundle 100 and wear of the protruding parts 210. As for the number of protruding parts 210 to be provided, it is preferred to arrange 3 to 12 pieces at equal intervals on the disk-shaped outer edge, more preferably 4 to 8 pieces.

Thus, when attempting to obtain a fiber bundle 100 with a stable fiber bundle width while giving priority to the proportion of fiber splitting and the life of the protruding parts, it is preferred that the rotating fiber splitting means 220 has an imaging means that detects a twist. Concretely, during normal operation until the imaging means detects the twist, the rotating fiber splitting means 220 intermittently repeats the rotation and the stop to perform the fiber splitting, and when the twist is detected, the rotational speed of the rotating fiber splitting means 220 is increased from the speed at the normal time and/or the stop time is shortened, thereby stabilizing the fiber bundle width.

Continuous Rotation Avoidance

It is also possible to control the stop time to zero, that is, to continue the rotation without stopping.

Continuous Rotating Fiber Splitting

Further, other than repeating the intermittent rotation and stopping of the rotating fiber splitting means 220, the rotating fiber splitting means 220 may always continue to rotate. At that time, it is preferred to make either one of the traveling speed of the fiber bundle 100 and the rotational speed of the rotating fiber splitting means 220 relatively earlier or slower. When the speed is the same, although split-fiber processed sections can be formed because the operation of piercing/pulling out of the protruding part 210 into/from the fiber bundle 100 is performed since the fiber-splitting operation acting on the fiber bundle 100 is weak, there is a possibility that the fiber splitting is not be performed sufficiently. Further, when any one of the speeds is too fast or too slow, the number of times the fiber bundle 100 and the protruding parts 210 come in contact with each other increases, there is a possibility that yarn breakage may occur due to rubbing, which causes to be inferior in continuous productivity.

Fiber Splitting Means: Up and Down Reciprocating

Our methods and devices may further include a reciprocating movement mechanism to perform the piercing and pulling out of the fiber splitting means 200 or the rotating fiber splitting means 220 by reciprocating movement of the fiber splitting means 200 or the rotating fiber splitting means 220. Further, it is also preferred to further include a reciprocating movement mechanism to reciprocate the fiber splitting means 200 and the rotating fiber splitting means 220 along the feed direction of the fiber bundle 100. For the reciprocating movement mechanism, it is possible to use a linear motion actuator such as a compressed-air or electric cylinder or slider.

Corner Portion

Figure 3:
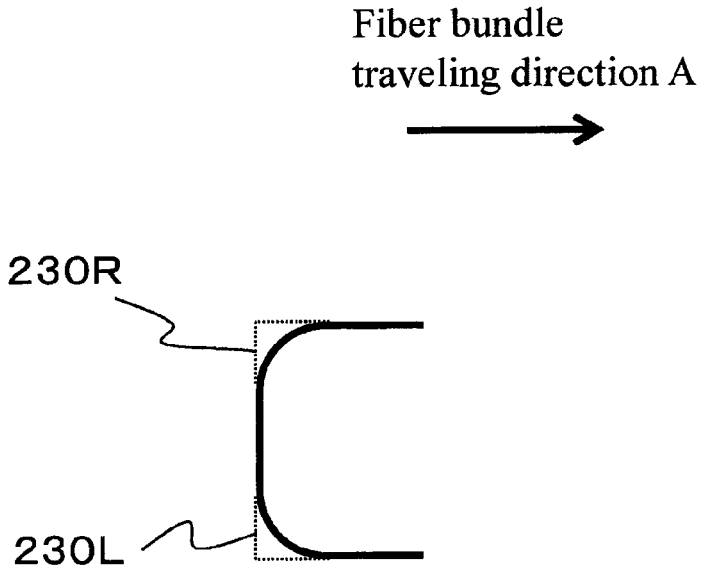
FIG. 3 is a partially enlarged diagram of a portion A in FIG. 2(A), showing an example of a contact part of a protruding part which forms a part of a fiber splitting means.

As shown in FIG. 3, it is preferred that the contact part with the fiber bundle 100 at the tip of the protruding part 210 is formed in a shape having a rounded corner. The corner portions 230L and 230R of the protruding part 210 preferably have a curved surface as a whole of a corner portion such as an arc shape (curvature radius: r) as shown in FIG. 4(A) or a shape in combination of partial circular arcs R1 and R2 (angle range: θ1, θ2, radius of curvature: r1, r2) and a straight line L1.

When the shape of the corner portion is insufficient and it is sharp, the single fiber tends to be easily cut, and it is likely to occur that the fiber bundle 100 is projected in a split end-like fashion or the occurrence of fluffs increases at the time of fiber splitting. If the split end split is projected, there is a possibility that causes a conveyance failure such as being wound around a roll during conveyance, or fluff accumulating on a drive roll and sliding the fiber bundle, or the like. Further, the cut single fibers may become fluffs and form an entangled part. If the entangled accumulation part where the entangled parts are accumulated becomes large, it tends to be caught by the fiber bundle unwound from the winding body.

Figure 4A:
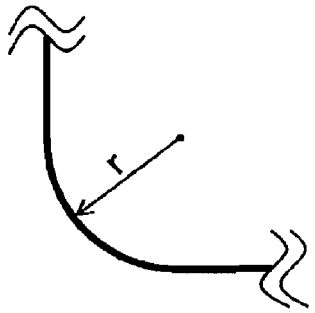
FIGS. 4(A) and 4(B) show schematic sectional views showing examples of a corner portion of a contact part in a protruding part.
Figure 4B:
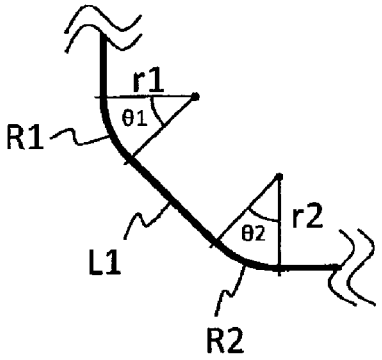

The radius of curvature r in FIG. 4(A) is preferably a dimension obtained by multiplying the thickness of the contact part by 0.01 to 0.5, more preferably 0.01 to 0.2. Further, a plurality of arc portions shown in FIG. 4(B) may be provided. The arc portion and the straight portion can be arbitrarily set.

Partial Split-Fiber Fiber Bundle

Figure 8:
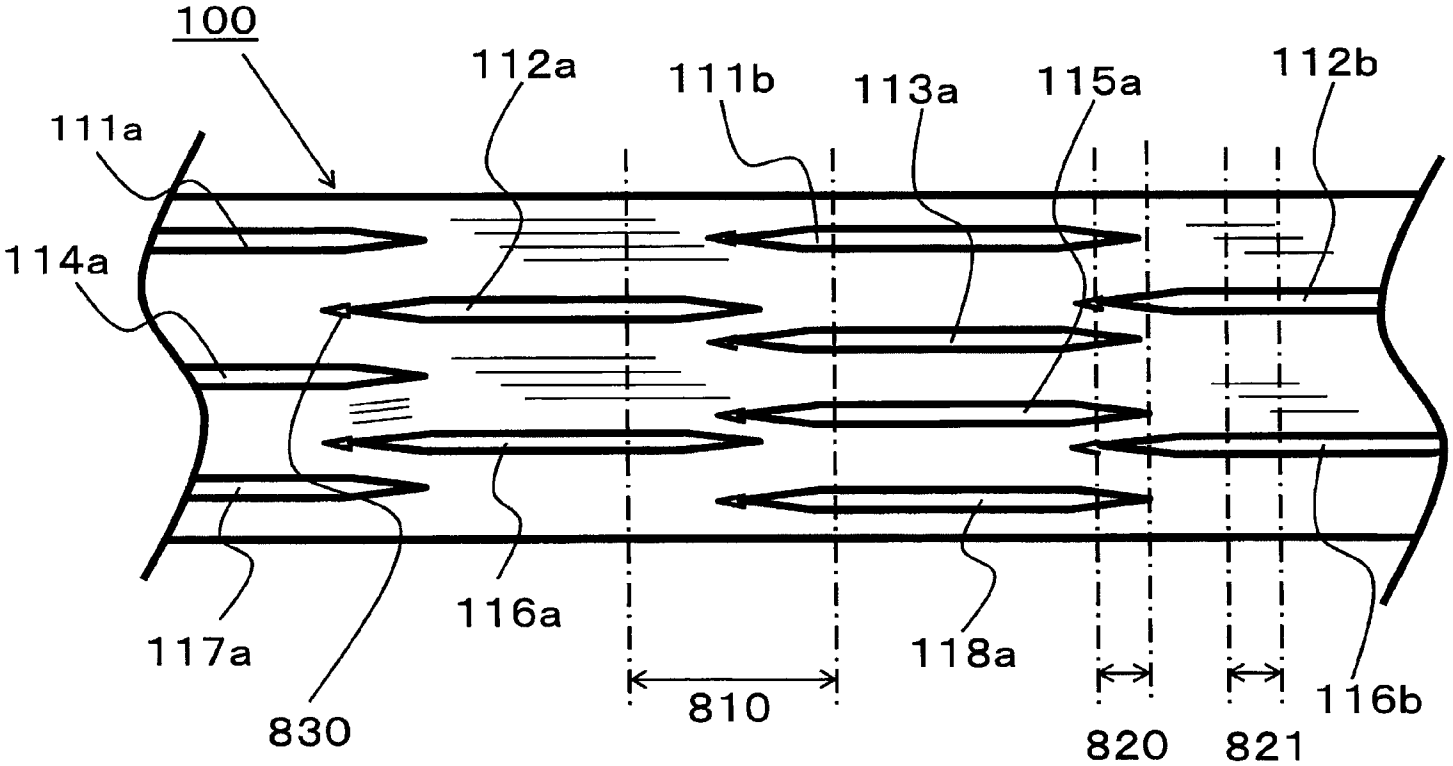
FIG. 8 is a schematic plan view showing an example of a split-fiber fiber bundle performed with fiber splitting to a fiber bundle.

The partial split-fiber fiber bundle will be explained. FIG. 8 is a schematic two-dimensional plan view showing an example of a split-fiber fiber bundle performed with fiber splitting to a fiber bundle. The partial split-fiber fiber bundle is characterized in that split-fiber processed sections 111*a* to 118*a* in each of which a fiber bundle 100 formed from a plurality of single fibers is performed with a partial fiber splitting along the longitudinal direction of the fiber bundle and split-fiber unprocessed sections formed between adjacent split-fiber processed sections are alternately formed.

Further, it is also preferred that an entanglement accumulation part 830 where entangled parts, in each of which the single fibers are interlaced, are accumulated, is formed in at least one end portion of at least one split-fiber processed section (split-fiber processed section 112*a* in the example shown in FIG. 8). As aforementioned, the entanglement accumulation part 830 is formed by forming (moving) the entanglement between the single fibers, which has been previously present in the split-fiber processed section, in the contact part 211 by the fiber splitting means 200 or by newly forming (creating) an aggregate, in which single fibers are entangled, by the fiber splitting means 200. When a plurality of fiber splitting means 200 are controlled independently, although an entanglement accumulation part 830 is formed at least at one end portion of at least one split-fiber processed section, when it is difficult to control a plurality of fiber splitting means 200 independently such as when single fibers forming the fiber bundle 100 originally have many entanglements, it is further preferred that the fiber splitting is performed on the plurality of fiber splitting means 200 under the same operating condition and an entanglement accumulation part including entangled parts, in each of which the single fibers are interlaced, is formed in at least one end portion of at least one split-fiber processed section.

Still further, the partial split-fiber fiber bundle can employ various examples as long as the split-fiber processed section and the split-fiber unprocessed section are alternately formed. As aforementioned, since it is possible to arrange a plurality of fiber splitting means 200 in the width direction of the fiber bundle 100 and control them independently, a plurality of the split-fiber processed sections and the split-fiber unprocessed sections which are alternately formed are preferably provided in parallel to the width direction of the fiber bundle 100.

Figures 9A, 9B, 9C:
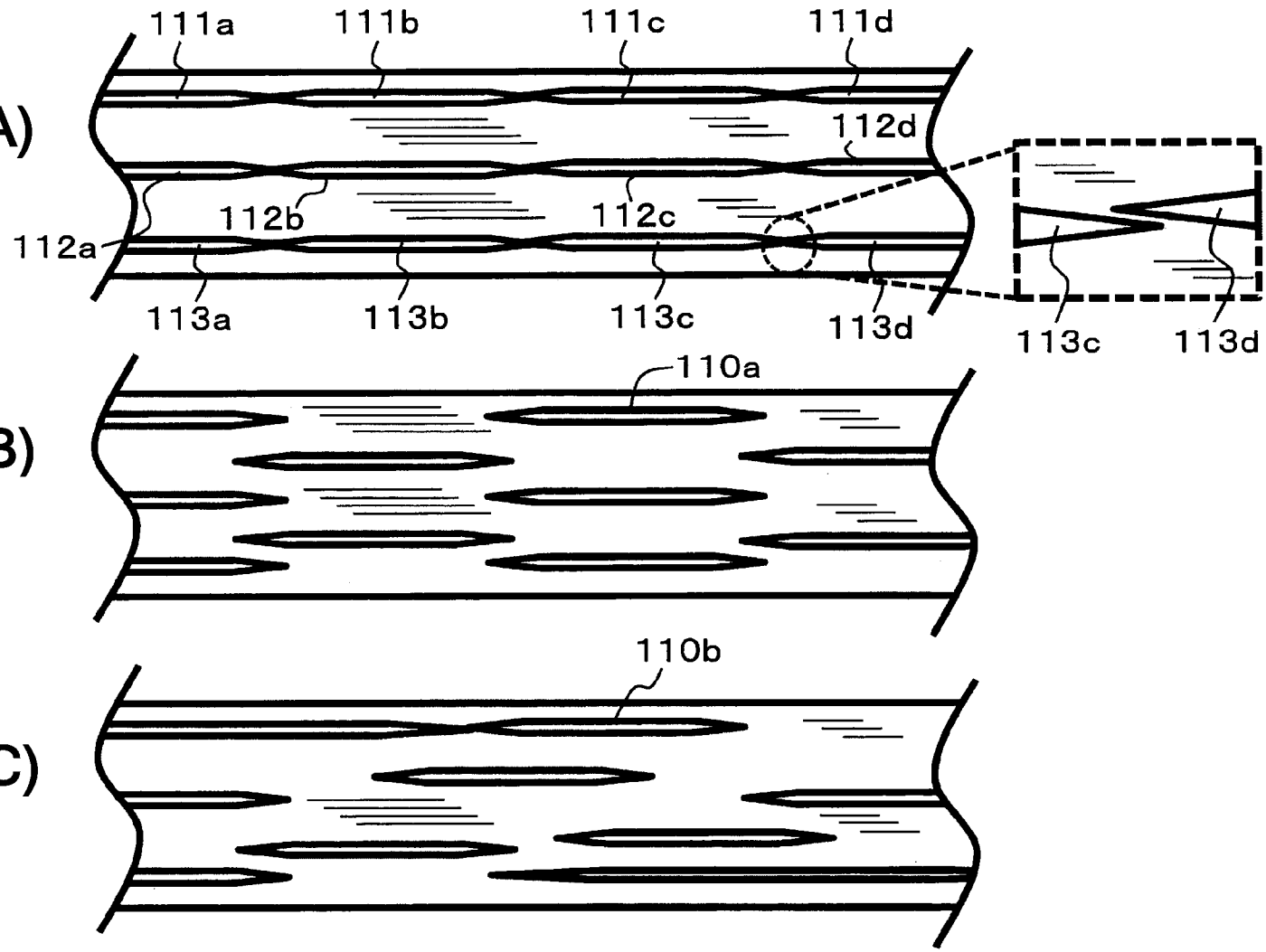
FIGS. 9(A), 9(B) and 9(C) show schematic plan views showing examples of partial split-fiber fiber bundles performed with fiber splitting to fiber bundles, (A) shows an example of a parallel fiber splitting, (B) shows an example of a staggering fiber splitting, and (C) shows an example of a random fiber splitting.

Concretely, as shown in FIG. 9(A), split-fiber processed sections (111*a* to 111*d*, 112*a* to 112*d*, 113*a* to 113*d*) are arranged in parallel, or as shown in FIG. 9(B), split-fiber processed sections 110*a* are arranged staggeringly, or as shown in FIG. 9(C), split-fiber processed sections 110*b* are arranged randomly or the like and, thus, the split-fiber processed sections can be arranged in such a state that the phase is arbitrarily shifted relatively to the width direction of the fiber bundle 100. In FIGS. 9(A) to 9(C), split-fiber processed sections of the same number in the code (for example, 111*a* and 111*b*) indicate that they were processed by the same fiber splitting means 200.

A plurality of alternately formed split-fiber processed sections and split-fiber unprocessed sections provided parallel to the width direction of the fiber bundle preferably have at least one split-fiber processed section in an arbitrary length in the longitudinal direction of the fiber bundle 100. For example, as shown in FIG. 8, taking an arbitrary length region 810 as an example, at least split-fiber processed sections 111*b*, 112*a*, 113*a*, 115*a*, 116*a* and 118*a* are included. In the arbitrary length region 810 or the arbitrary length region 820, on end portion of any one of the split-fiber processed sections is included in the region, but this disclosure is not limited to such an example, and as in an arbitrary length region 821, only the central portions of the split-fiber processed sections 112*b* and 116*b* may be included. Thus, the number of split-fiber processed sections included in the arbitrary length region may not be constant, and by a condition where the number of split-fiber processed sections varies, for example, when a partial split-fiber fiber bundle is cut to a predetermined length at a later process to make discontinuous fibers, a position where the number of split-fiber processed sections is large becomes a starting point for fiber splitting and it can be facilitated to control the division into fiber bundles each having a predetermined number of single fibers. On the other hand, when the partial split-fiber fiber bundle is used as continuous fibers without cutting it, when a reinforcing fiber composite material is made by impregnating a resin or the like thereinto in a later process, a starting point for resin impregnation into the reinforcing fiber bundle is made from a region included with many split-fiber processed sections, the molding time can be shortened and voids and the like in the reinforcing fiber composite material can be reduced.

Although the split-fiber unprocessed section has been explained as a section between adjacent end portions of one split-fiber processed section having been finished with fiber splitting (one example: 111*a* in FIG. 8) and a split-fiber processed section (111*b*) which is newly created by fiber splitting performed with a certain distance, our methods and devices are not limited thereto. As exemplified in a partially enlarged diagram of FIG. 9(A), the split-fiber unprocessed sections may not be formed in the section between the end portions of the split-fiber processed sections 113*c* and 113*d* with respect to the longitudinal direction of the fiber bundle. Even in such a case, if the fiber splitting position is shifted in the width direction of the fiber bundle 100 at the single fiber level and different split-fiber processed sections are formed respectively, insofar as they exist as split-fiber processed sections each having a limited length in the longitudinal direction of the fiber bundle, the end portions of split-fiber processed sections may be close to each other (substantially connected). By a condition where the fiber splitting positions are shifted with respect to the width direction at least at the single fiber level and separate split-fiber processed sections are formed, when the fiber splitting is performed continuously, it is possible to suppress yarn breakage and occurrence of fluffs, and it is possible to obtain split-fiber fiber bundles with good quality.

If yarn breakage is caused in the partial split-fiber fiber bundle, when the partial split-fiber fiber bundle is cut to a predetermined length to be made into a discontinuous fiber reinforced composite material, the cut length becomes short at the position of being caused with yarn breakage, and there is a possibility that the mechanical properties made into the discontinuous fiber reinforced composite material may decrease. Further, even when the partial split-fiber fiber bundle is used as continuous fibers, the fiber becomes discontinuous at the portion of being caused with yarn breakage, and there is a possibility that the mechanical properties may decrease.

The number of split-fiber processed sections when using reinforcing fibers for fiber bundles is preferably at least (F/10,000−1) or more and less than (F/50−1) in a certain region in the width direction. F is the total number of single fibers forming the fiber bundle to be performed with fiber splitting. By providing the split-fiber processed sections controlled in number thereof at least at (F/10,000−1) or more in a certain region in the width direction, when the partial split-fiber fiber bundle is cut to a predetermined length to be made into a discontinuous fiber reinforced composite material, because the end portion of the reinforcing fiber bundle in the discontinuous fiber reinforced composite material is finely divided, a discontinuous fiber reinforced composite material having excellent mechanical properties can be obtained. Further, when the partial split-fiber fiber bundle is used as continuous fibers without cutting it, when a reinforcing fiber composite material is made by impregnating a resin or the like thereinto in a later process, a starting point for resin impregnation into the reinforcing fiber bundle is made from a region included with many split-fiber processed sections, the molding time can be shortened and voids and the like in the reinforcing fiber composite material can be reduced. By controlling the number of split-fiber processed sections to less than (F/50−1), the obtained partial split-fiber fiber bundle becomes hard to cause yarn breakage, and the decrease of mechanical properties when made into a fiber-reinforced composite material can be suppressed.

If the split-fiber processed sections are provided with periodicity or regularity in the longitudinal direction of fiber bundle 100, for when the partial split-fiber fiber bundle is cut to a predetermined length in a later process to make discontinuous fibers, it is possible to easily control to a predetermined number of split-fiber fiber bundles.

EXAMPLES

Next, examples and comparative examples will be explained. This disclosure is not limited in any way to the examples and comparative examples.

First, the fiber bundle (reinforcing fiber bundle) used in Examples and Comparative Examples will be explained.

Fiber Bundle (1):

A continuous carbon fiber bundle having a fiber diameter of 7 μm, a tensile elastic modulus of 230 GPa and a filament number of 12,000 was used.

Fiber Bundle (2):

A continuous carbon fiber bundle having a fiber diameter of 7.2 μm, a tensile elastic modulus of 240 GPa and a filament number of 50,000 was used.

Example 1

Split-fiber fiber bundles were prepared by the method shown in FIGS. 2(A) and 2(B). The reinforcing fiber bundle (1) was unwound using a winder at a constant speed of 10 m/min, and the unwound reinforcing fiber bundle (1) passed through a vibration widening roll vibrating in its axial direction at 5 Hz and, after widening the width of the reinforcing fiber bundle, a widened reinforcing fiber bundle widened to 20 mm was obtained by passing it through a width regulating roll regulated to a width of 20 mm. For the obtained widened fiber bundle, a fiber splitting means was prepared by setting iron plates for fiber splitting each having a protruding shape with a thickness of 0.3 mm, a width of 3 mm and a height of 20 mm in parallel and at equal intervals of 5 mm with respect to the width direction of the reinforcing fiber bundle. This fiber splitting means was intermittently pierced into and pulled out from the widened reinforcing fiber bundle as shown in FIGS. 2(A) and 2(B) to prepare a partial split-fiber fiber bundle.

At this time, the fiber splitting means was pierced for 3 seconds into the widened fiber bundle traveling at a constant speed of 10 m/min to create a split-fiber processed section, and the fiber splitting means was pulled out for 0.2 second, and it was pierced once again, and these steps were repeated.

In the obtained partial split-fiber fiber bundle, the fiber bundle was split and divided into four parts in the width direction in the split-fiber processed section, and at least at one end portion of at least one split-fiber processed section, an entanglement accumulation part accumulated with the entangled parts in which the single fibers were interlaced was formed. When the partial split-fiber fiber bundle was manufactured by 500 m, the twist of the fibers existing in the fiber bundle passed through in the traveling direction when pulling out and piercing the fiber splitting means without causing yarn breakage and winding at all, and it was possible to carry out the fiber splitting with a stable width. The results are shown in Table 1.

Example 2

A partial split-fiber fiber bundle was prepared in a manner similar to in Example 1 other than a condition where the reinforcing fiber bundle (2) was used, after the reinforcing fiber bundle was widened, it was passed through a regulating roll regulated to a width of 25 mm to obtain a widened reinforcing fiber bundle widened to 25 mm. In the obtained partial split-fiber fiber bundle, the fiber bundle was split and divided into five parts in the width direction in the split-fiber processed section, and at least at one end portion of at least one split-fiber processed section, an entanglement accumulation part accumulated with the entangled parts in which the single fibers were interlaced was formed. When the partial split-fiber fiber bundle was manufactured by 500 m, the twist of the fibers existing in the fiber bundle passed through in the traveling direction when pulling out and piercing the fiber splitting means without causing yarn breakage and winding at all, and it was possible to carry out the fiber splitting with a stable width. The results are shown in Table 1.

Example 3

Using the reinforcing fiber bundle (2), the reinforcing fiber bundle was passed through a vibration widening roll vibrating in its axial direction at 10 Hz, and after widening the width, the fiber bundle passed through a width regulating roll regulated to a width of 50 mm to obtain a widened reinforcing fiber bundle widened to 50 mm. A partial split-fiber fiber bundle was prepared in a manner similar to in Example 1 other than a condition using a fiber splitting means in which iron plates for fiber splitting each having a protruding shape in parallel and at equal intervals of 1 mm were set with respect to the width direction of the reinforcing fiber bundle, for the obtained widened fiber bundle. In the obtained partial split-fiber fiber bundle, the fiber bundle was split and divided into 39 parts in the width direction in the split-fiber processed section, and at least at one end portion of at least one split-fiber processed section, an entanglement accumulation part accumulated with the entangled parts in which the single fibers were interlaced was formed. Further, the quality of the entanglement accumulation part was excellent as compared to that in Example 2. When the partial split-fiber fiber bundle was manufactured by 500 m, the twist of the fibers existing in the fiber bundle passed through in the traveling direction when pulling out and piercing the fiber splitting means without causing yarn breakage and winding at all, and it was possible to carry out the fiber splitting with a stable width. The results are shown in Table 1.

Example 4

Using the reinforcing fiber bundle (2), a partial split-fiber fiber bundle was prepared by the method as shown in FIG. 6(A). The reinforcing fiber bundle was once passed through a vibration widening roll vibrating in its axial direction at 10 Hz, and after widening the width, the fiber bundle passed through a width regulating roll regulated to a width of 50 mm to obtain a widened reinforcing fiber bundle widened to 50 mm. The obtained widened reinforcing fiber bundle was allowed to stand still in a tensioned state, a fiber splitting means similar to that in Example 3, in which iron plates for fiber splitting each having a protruding shape in parallel and at equal intervals of 1 mm were set with respect to the width direction of the reinforcing fiber bundle, was pierced, and after the fiber splitting means was traveled by 40 mm in a direction opposite to the winding direction with respect to the longitudinal direction of the fiber bundle, it was pulled out, and at the state pulled out, it was returned to the original position. At the same time, the widened fiber bundle was wound by 39 mm with respect to the winding direction, stopped in a state where the tension was applied again, and the fiber splitting means pierced again so that the fiber splitting means was overlapped by 1 mm with respect to the longitudinal direction of the fiber bundle. After that, the same operation was repeated to obtain a partial split-fiber fiber bundle.

Although the obtained partial split-fiber fiber bundle had an entanglement accumulation part in which entangled parts, in which single fibers were interlaced, were accumulated at least at one end portion of at least one split-fiber processed section, as compared to Example 3, a partial split-fiber fiber bundle could be obtained in which the entanglement accumulation part was inconspicuous and had a better quality and which had at least one split-fiber processed section or more at an arbitrary length in the longitudinal direction of the partial split-fiber fiber bundle, and in which, as shown in FIG. 9(A), the positions of split-fiber processed section positions adjacent to each other were shifted with respect to the width direction of the fiber bundle in the section overlapped with the fiber splitting means, and which was split and divided into 39 parts in the width direction in the split-fiber processed section, although the split fiber bundles were connected to each other by a single fiber and/or a plurality of single fibers. When the partial split-fiber fiber bundle was manufactured by 500 m, the twist of the fibers existing in the fiber bundle passed through in the traveling direction when pulling out and piercing the fiber splitting means without causing yarn breakage and winding at all, and it was possible to carry out the fiber splitting with a stable width. The results are shown in Table 1.

TABLE 1

| | | Example 1 | Example 2 | Example 3 | Example 4 |
|---|---|---|---|---|---|
| Fiber bundle | | Fiber bundle (1) | Fiber bundle (2) | Fiber bundle (2) | Fiber bundle (2) |
| Width for widening regulation | mm | 20 | 25 | 50 | 50 |
| Interval of fiber splitting means | mm | 5 | 5 | 1 | 1 |
| Time for piercing fiber splitting means | sec | 3 | 3 | 3 | — |
| Time for pulling out fiber splitting means | sec | 0.2 | 0.2 | 0.2 | — |
| Distance of overlapping | mm | — | — | — | 1 |
| Process trouble | — | None | None | None | None |
| Number of division of split-fiber processed sections | Divided | 4 | 4 | 39 | 39 |

Comparative Example 1

Using the reinforcing fiber bundle (1), the operation was performed in a manner similar to in Example 1 other than a condition where the fiber splitting means was kept in a state of being always pierced into the reinforcing fiber bundle to make a continuous split-fiber fiber bundle performed with continuous fiber splitting. In the obtained continuous split-fiber fiber bundle, the split-fiber processed section was formed continuously in the longitudinal direction of the fiber bundle, deterioration of quality due to remarkable fluffing was observed in a part, the twist of fibers present in the fiber bundle was accumulated to the fiber splitting means, thereby causing a partial yarn breakage, and a continuous fiber splitting could not be performed. The results are shown in Table 2.

Comparative Example 2

Using the reinforcing fiber bundle (2), a processed fiber bundle was prepared in a manner similar to in Example 3 other than a condition where the fiber splitting means was kept in a state of being always pierced into the reinforcing fiber bundle to make a continuous split-fiber fiber bundle performed with continuous fiber splitting. In the obtained continuous split-fiber fiber bundle, the split-fiber processed section was formed continuously in the longitudinal direction of the fiber bundle, deterioration of quality due to remarkable fluffing was observed in a part, the twist of fibers present in the fiber bundle was accumulated to the fiber splitting means, thereby causing a partial yarn breakage, and a continuous fiber splitting could not be performed. The results are shown in Table 2.

TABLE 2

| | | Comparative Example 1 | Comparative Example 2 |
|---|---|---|---|
| Fiber bundle | | Fiber bundle (1) | Fiber bundle (2) |
| Width for widening regulation | mm | 20 | 50 |
| Interval of fiber splitting means | mm | 5 | 1 |
| Time for piercing fiber splitting means | sec | — | — |
| Time for pulling out fiber splitting means | sec | — | — |
| Distance of overlapping | mm | — | — |
| Process trouble | — | Partial yarn breakage | Partial yarn breakage |
| Number of division of split-fiber processed sections | Divided | 4 | 39 |

INDUSTRIAL APPLICABILITY

Our methods and devices can be applied to any fiber bundle in which it is desired to split a fiber bundle composed of a plurality of single fibers into two or more thin bundles. In particular, when reinforcing fibers are used, the obtained partial split-fiber fiber bundle can be impregnated with a matrix resin and used for any reinforcing fiber composite material.

The invention claimed is:

1. A method of manufacturing a partial split-fiber fiber bundle comprising:

causing a fiber bundle formed from a plurality of single fibers to be traveled along a longitudinal direction thereof, piercing said fiber bundle with a fiber splitting means provided with a plurality of protruding parts in a width direction of said fiber bundle to create a split-fiber processed part, and entangled parts, where said single fibers are interlaced, are formed at contact parts with said protruding parts in at least one said split-fiber processed part, thereafter said fiber splitting means is pulled out of said fiber bundle, and after an entanglement accumulation part including said entangled parts formed by said protruding parts respectively passes through a position corresponding to a position of said fiber splitting means having been pulled out, said fiber splitting means is once again pierced into said fiber bundle, and detecting a pressing force acting on said protruding parts in a width direction of said fiber bundle within a width of said fiber bundle at said contact parts, and, when an increase in the pressing force is detected, pulling said fiber splitting means out of said fiber bundle.

2. The method according to claim 1, wherein, after said fiber splitting means is pulled out of said fiber bundle, said fiber splitting means is once again pierced into said fiber bundle after a predetermined time passes.

3. The method according to claim 1, wherein, after said fiber splitting means is pierced into said fiber bundle, said fiber splitting means is pulled out of said fiber bundle after a predetermined time passes.

4. The method according to claim 1, wherein an imaging means that detects presence of a twist of said fiber bundle in a range of 10 to 1,000 mm in at least one of a front and rear of said fiber bundle along the longitudinal direction of said fiber bundle from said fiber splitting means having been pierced into said fiber bundle is further provided.

5. The method according to claim 4, wherein a pressing force acting on said protruding parts within a width of said fiber bundle at said contact parts is detected, a twist is detected by said imaging means, and said fiber splitting means is controlled so that said pressing force is reduced from a time immediately before said protruding parts contact said twist until said protruding parts are passed through said twist.

6. The method according to claim 1, wherein each of said plurality of protruding parts can be controlled independently.

7. The method according to claim 1, wherein said fiber splitting means has a rotational shaft orthogonal to the longitudinal direction of said fiber bundle, and said protruding parts are provided on a surface of said rotational shaft.

8. The method according to claim 1, wherein said fiber bundle comprises reinforcing fibers.

9. The method according to claim 8, wherein said reinforcing fibers are carbon fibers.

10. A method of manufacturing a partial split-fiber fiber bundle comprising:

piercing a fiber splitting means provided with a plurality of protruding parts into a fiber bundle formed from a plurality of single fibers while said fiber splitting means travels along a longitudinal direction of said fiber bundle to create a split-fiber processed part, and entangled parts, where said single fibers are interlaced, are formed at contact parts with said protruding parts in at least one said split-fiber processed part, thereafter said fiber splitting means is pulled out of said fiber bundle, and after said fiber splitting means having been pulled out travels to a position corresponding to a position of passing through an entanglement accumulation part including said entangled parts formed by said plurality of protruding parts provided in a width direction of said fiber bundle respectively, said fiber splitting means is once again pierced into said fiber bundle, and detecting a pressing force acting on said protruding parts in a width direction of said fiber bundle within a width of said fiber bundle at said contact parts, and, when an increase in the pressing force is detected, pulling said fiber splitting means out of said fiber bundle.

11. The method according to claim 10, wherein, after said fiber splitting means is pulled out of said fiber bundle, said fiber splitting means is once again pierced into said fiber bundle after a predetermined time passes.

12. The method according to claim 10, wherein, after said fiber splitting means is pierced into said fiber bundle, said fiber splitting means is pulled out of said fiber bundle after a predetermined time passes.

13. The method according to claim 10, wherein said fiber splitting means has a rotational shaft orthogonal to the longitudinal direction of said fiber bundle, and said protruding parts are provided on a surface of said rotational shaft.

14. The method according to claim 10, wherein said fiber bundle comprises reinforcing fibers.

15. The method according to claim 14, wherein said reinforcing fibers are carbon fibers.

16. The method according to claim 10, wherein each of said plurality of protruding parts can be controlled independently.

17. A method of manufacturing a partial split-fiber fiber bundle comprising:

causing a fiber bundle formed from a plurality of single fibers to be traveled along a longitudinal direction thereof, piercing said fiber bundle with a fiber splitting means provided with a plurality of protruding parts in a width direction of said fiber bundle to create a split-fiber processed part, and entangled parts, where said single fibers are interlaced, are formed at contact parts with said protruding parts in at least one said split-fiber processed part, thereafter said fiber splitting means is pulled out of said fiber bundle, and after an entanglement accumulation part including said entangled parts formed by said protruding parts respectively passes through a position corresponding to a position of said fiber splitting means having been pulled out, said fiber splitting means is once again pierced into said fiber bundle, wherein an imaging means that detects presence of a twist of said fiber bundle in a range of 10 to 1,000 mm in at least one of a front and rear of said fiber bundle along the longitudinal direction of said fiber bundle from said fiber splitting means having been pierced into said fiber bundle is further provided.

18. The method according to claim 17, wherein, after said fiber splitting means is pulled out of said fiber bundle, said fiber splitting means is once again pierced into said fiber bundle after a predetermined time passes.

19. The method according to claim 17, wherein, after said fiber splitting means is pierced into said fiber bundle, said fiber splitting means is pulled out of said fiber bundle after a predetermined time passes.

20. The method according to claim 17, wherein said fiber splitting means has a rotational shaft orthogonal to the longitudinal direction of said fiber bundle, and said protruding parts are provided on a surface of said rotational shaft.

21. The method according to claim 17, wherein said fiber bundle comprises reinforcing fibers.

22. The method according to claim 21, wherein said reinforcing fibers are carbon fibers.

23. The method according to claim 17, wherein a pressing force acting on said protruding parts within a width of said fiber bundle at said contact parts is detected, a twist is detected by said imaging means, and said fiber splitting means is controlled so that said pressing force is reduced from a time immediately before said protruding parts contact said twist until said protruding parts are passed through said twist.

24. The method according to claim 17, wherein each of said plurality of protruding parts can be controlled independently.

25. A method of manufacturing a partial split-fiber fiber bundle comprising:

piercing a fiber splitting means provided with a plurality of protruding parts into a fiber bundle formed from a plurality of single fibers while said fiber splitting means travels along a longitudinal direction of said fiber bundle to create a split-fiber processed part, and entangled parts, where said single fibers are interlaced, are formed at contact parts with said protruding parts in at least one said split-fiber processed part, thereafter said fiber splitting means is pulled out of said fiber bundle, and after said fiber splitting means having been pulled out travels to a position corresponding to a position of passing through an entanglement accumulation part including said entangled parts formed by said plurality of protruding parts provided in a width direction of said fiber bundle respectively, said fiber splitting means is once again pierced into said fiber bundle, wherein an imaging means that detects presence of a twist of said fiber bundle in a range of 10 to 1,000 mm in at least one of a front and rear of said fiber bundle along the longitudinal direction of said fiber bundle from said fiber splitting means having been pierced into said fiber bundle is further provided.

26. The method according to claim 25, wherein, after said fiber splitting means is pulled out of said fiber bundle, said fiber splitting means is once again pierced into said fiber bundle after a predetermined time passes.

27. The method according to claim 25, wherein, after said fiber splitting means is pierced into said fiber bundle, said fiber splitting means is pulled out of said fiber bundle after a predetermined time passes.

28. The method according to claim 25, wherein said fiber splitting means has a rotational shaft orthogonal to the longitudinal direction of said fiber bundle, and said protruding parts are provided on a surface of said rotational shaft.

29. The method according to claim 25, wherein said fiber bundle comprises reinforcing fibers.

30. The method according to claim 29, wherein said reinforcing fibers are carbon fibers.

31. The method according to claim 25, wherein a pressing force acting on said protruding parts within a width of said fiber bundle at said contact parts is detected, a twist is detected by said imaging means, and said fiber splitting means is controlled so that said pressing force is reduced from a time immediately before said protruding parts contact said twist until said protruding parts are passed through said twist.

32. The method according to claim 25, wherein each of said plurality of protruding parts can be controlled independently.

* * * * *